United States Patent [19]

Yokoyama et al.

[11] 4,083,414

[45] Apr. 11, 1978

[54] COMBINATION ANGLING-TILTING BULLDOZER

[75] Inventors: Masao Yokoyama; Tsuneo Sughihira; Koji Ohta, all of Hirakata, Japan

[73] Assignee: Kabushiki Kaisha Komatsu Seisakusho, Tokyo, Japan

[21] Appl. No.: 645,353

[22] Filed: Dec. 30, 1975

[51] Int. Cl.[2] ..... E02F 3/76

[52] U.S. Cl. ..... 172/804

[58] Field of Search ..... 172/803, 804, 806, 807, 172/809

[56] References Cited

U.S. PATENT DOCUMENTS

| | | | |
|---|---|---|---|
| 3,246,406 | 4/1966 | Ray, Jr. | 172/804 |
| 3,529,678 | 9/1970 | Teasdale | 172/804 |
| 3,795,280 | 3/1974 | Casey | 172/804 |
| 3,913,684 | 10/1975 | Casey et al. | 172/804 |

FOREIGN PATENT DOCUMENTS

| | | | |
|---|---|---|---|
| 97,101 | 8/1975 | Japan | 172/804 |

*Primary Examiner*—Richard T. Stouffer

*Attorney, Agent, or Firm*—Armstrong, Nikaido, Marmelstein & Kubovcik

[57] ABSTRACT

A bulldozer assembly has a swivel connection between blade and C-frame for permitting both angling and tilting motions of the former relative to the latter. The swivel connection comprises a swivel block mounted centrally astride the front end of the frame for pivotal or tilting motion relative to same in its lateral direction about a horizontal axis. The swivel block is hingedly jointed to the blade so that the latter may be tilted simultaneously with the block but free to angle relative to same about a normally vertical axis. A tilt cylinder is operatively connected between frame and swivel block, and a pair of laterally spaced angle cylinders between frame and blade.

3 Claims, 4 Drawing Figures

COMBINATION ANGLING-TILTING BULLDOZER

BACKGROUND OF THE INVENTION

This invention relates to bulldozers, and in particular to improvements in a bulldozer assembly whose blade can be both angled (set so that either of its sides is ahead of the other for windrowing, backfilling and like operations) and tilted (pivoted about a horizontal axis to cut low on either side).

In conventional bulldozers of the type capable of both angling and tilting functions, it has been common to employ a universal ball and socket connection between blade and C-frame and to cause the former to angle and tilt relative to the latter by means of hydraulic cylinders or like actuators arranged therebetween. The ball and socket connection must of necessity be of very complex and expensive construction since it is relatively easy to be overstressed during operation of the tractor-bulldozer unit. Another objection to the ball and socket connection is that it does not provide sufficiently stable support for the blade.

SUMMARY OF THE INVENTION

It is an object of this invention to provide an improved bulldozer assembly including a simplified, economical, trouble-free swivel connection between blade and frame which is designed to permit both angling and tilting motions of the blade relative to the frame.

Another object of the invention is to provide a combination angling-tilting bulldozer assembly of the above described character in which the blade can be more stably supported on the frame than in the prior art bulldozer incorporating the universal ball and socket connection.

According to this invention, briefly summarized, the bulldozer assembly includes a swivel connection between frame and blade adapted to permit both angling and tilting motions of the latter relative to the former. The swivel connection comprises a swivel member pivotally mounted centrally on the front end of the frame so as to effect tilting motion relative to same in its lateral direction about a horizontal axis, and joint means connecting the swivel member to the blade so that the blade may be tilted simultaneously with the swivel member but is free to angle relative to same about a normally vertical axis. The bulldozer assembly further comprises first actuator means for causing the tilting motion of the swivel member, and therefore of the blade, relative to the frame about the horizontal axis, and second actuator means for causing the angling motion of the blade relative to the swivel member, and therefore the frame, about the normally vertical axis.

In a preferred embodiment of the invention hereinafter disclosed, the joint means of the swivel connection comprises a plurality of knuckles projecting forwardly from the swivel member in normally vertically spaced relationship and adapted for interfitting engagement with companion knuckles projecting rearwardly from the blade. A pivot pin extends through the interfitting knuckles to provide the normally vertical axis about which the blade is permitted to angle.

The features which are believed to be novel and characteristic of this invention are set forth in particular in the appended claims. The invention itself, however, both as to its construction and method of operation, together with additional objects and advantages thereof, will become apparent from the following description of the preferred embodiment, which is to be read in connection with the accompanying drawings in which like reference characters refer to like parts throughout.

DESCRIPTION OF THE PREFERRED EMBODIMENT

Figure 1:
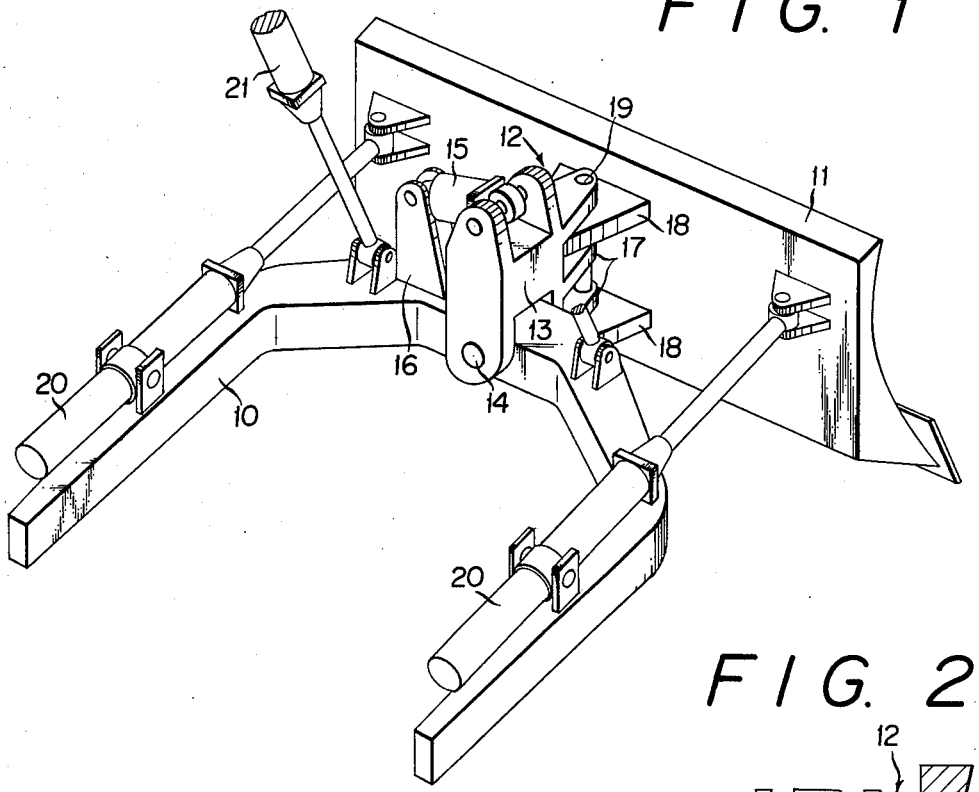
FIG. 1 is a perspective view of a combination angling-tilting bulldozer assembly constructed in accordance with the novel concepts of this invention.

With particular reference to FIG. 1 the illustrated preferred form of the angling-tilting bulldozer assembly according to this invention broadly comprises a C-frame 10 pivotally attached to the front of a wheeled or crawler tractor, not shown, a bulldozer blade 11 arranged forwardly of the frame, and a swivel connection 12 operatively connecting the frame and the blade to permit both angling and tilting motions of the latter relative to the former.

Figure 2:
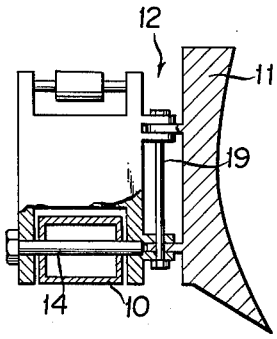
FIG. 2 is a vertical sectional view, partly in side elevation, of a swivel connection between frame and blade in the bulldozer assembly of FIG. 1.

As will be seen also from FIG. 2, the swivel connection 12 includes a swivel member in the form of a block 13 mounted centrally on or astride the front end of the frame 10 and coupled thereto at its bottom end by a horizontal pivot pin 14 for swiveling or tilting motion relative to the frame in its lateral direction. First actuator means comprising a tilt cylinder 15, preferably of the hydraulic type, is operatively connected between the top end of the swivel block 13 and a bracket 16 fixedly mounted on the frame 10 for causing the tilting motion of the block about the horizontal pivot pin 14.

The swivel block 13 is coupled to the blade 11 via joint means such that the blade tilts simultaneously with the block but is permitted to angle relative to same. In this particular embodiment of the invention the joint means, forming a part of the swivel connection 12, is shown to comprise a plurality of normally vertically spaced knuckles 17 projecting forwardly from the swivel block 13 and related to companion knuckles 18 formed centrally on the back of the blade 11. The knuckles 17 and 18 are arranged in interfitting, normally vertically aligned relationship to receive a pivot pin 9 therethrough. For convenience, the pivot pin 19 is hereinafter referred to as the vertical pivot pin.

Second actuator means comprising a pair of laterally spaced angle cylinders 20, preferably of the hydraulic type, are operatively connected between the frame 10 and the blade 11 for causing the angling motion of the blade about the vertical pivot pin 19. Although not specifically illustrated, the necessary hydraulic fluid conduits communicating the tilt and angle cylinders 15 and 20 with a source of pressurized fluid via suitable controls can be arranged on the frame 10. Preferably, such conduits should be suitably shielded for protection against damage by rocks or the like which may fall over the blade 11 during operation of the tractor-bulldozer unit.

The bulldozer assembly is further provided with a pair of lift cylinders 21 operatively connected between the frame 10 and the tractor to selectively raise or lower the bulldozer assembly relative to the tractor, only one of the lift cylinders being shown in FIG. 1. These lift cylinders, however, do not constitute an essential feature of this invention.

Figure 3:
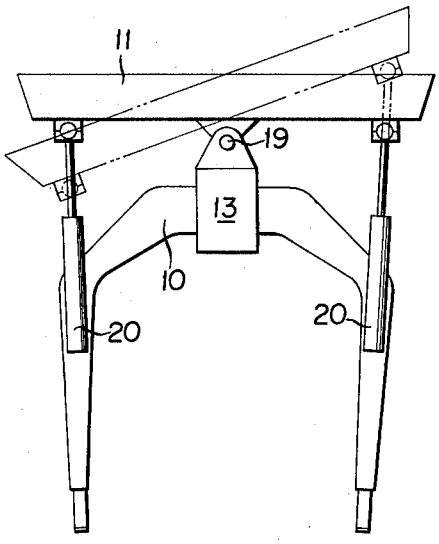
FIG. 3 is a schematic top plan view explanatory of the angling operation of the bulldozer assembly of FIG. 1.

In operation, for causing the angling motion of the blade 11 relative to the frame 10, one of the angle cylinders 20 may be extended and the other angle cylinder retracted. Thereupon, as illustrated in FIG. 3, one side of the blade 11 to which is connected the extended angle cylinder 20 will be thrusted ahead of the opposite side to which is connected the retracted angle cylinder. The blade 11 is thus angled about the vertical pivot pin 19 relative to the swivel block 13 and therefore the frame 10.

Figure 4:
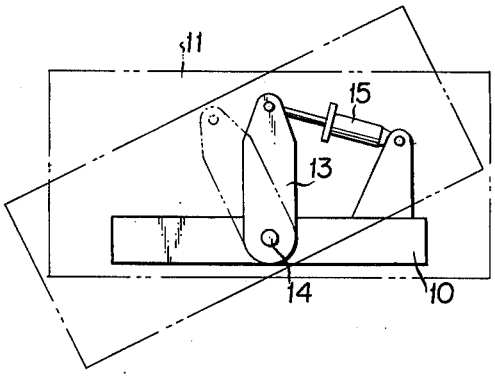
FIG. 4 is a schematic front elevational view explanatory of the tilting operation of the bulldozer assembly of FIG. 1.

For causing the tilting motion of the blade 11 relative to the frame 10, the tilt cylinder 15 may be extended or retracted, as desired, so that the swivel block 13 is swiveled or tilted laterally on the frame about the horizontal pivot pin 14, as illustrated in FIG. 4. Since the blade 11 is jointed to the swivel block 13 via the vertical pivot pin 19 extending through the interfitting knuckles 17 and 18, the blade is tilted simultaneously with the swivel block relative to the frame 10.

It will be seen that in the illustrated embodiment of the invention, the blade is connected to the rest of the bulldozer assembly at four different points and can therefore be more securely supported than in the prior art bulldozer employing the ball and socket connection. Moreover, the swivel connection according to the invention is effective to bear the load on the upper portion of the bulldozer blade, thereby lessening the stress exerted on the angle cylinders.

Although the improved angling-tilting bulldozer according to this invention has been described in terms of its preferred form illustrated in the accompanying drawings, it is to be understood that the invention itself is not limited to the exact details disclosed and that various changes and modifications may be effected therein by those skilled in the art without departing from the spirit or scope of the invention as expressed in the following claims.

We claim:

1. A combination angling-tilting bulldozer assembly comprising, in combination:

(a) a frame;

(b) a blade arranged forwardly of said frame;

(c) a swivel connection between said frame and said blade adapted to permit both angling and tilting motions of said blade relative to said frame, said swivel connection comprising:

(1) a swivel member pivotally mounted centrally on the front end of said frame for tilting motion relative to said frame in its lateral direction about a horizontal axis; and (2) joint means connecting said swivel member to said blade in such a manner that said blade is caused to tilt simultaneously with said swivel member about said horizontal axis and is permitted to angle relative to said swivel member about a normally vertical axis;

(d) first actuator means for causing the tilting motion of said swivel member and therefore of said blade relative to said frame about said horizontal axis; and (e) a pair of second actuator means each second actuator means being connected between said frame and an end of said blade for causing the angling motion of said blade relative to said swivel member and said frame about said normally vertical axis wherein said blade is supported at both ends by said pair of second actuator means and at the center by said joint means.

2. A bulldozer assembly as recited in claim 1, wherein said joint means of said swivel connection comprises:

(a) a plurality of first knuckles projecting forwardly from said swivel member, said first knuckles being normally vertically spaced from each other;

(b) a plurality of second knuckles projecting rearwardly from said blade and arranged in interfitting relationship to said first knuckles; and (c) a pivot pin extending normally vertically through said first and second knuckles.

3. The bulldozer assembly as recited in claim 1, wherein said swivel member of said swivel connection is a block pivotally coupled at its bottom end to said frame, and wherein said first actuator means comprises a fluid actuated cylinder operatively connected between said frame and the top end of said block.

* * * * *